US008793918B2

(12) United States Patent
Rogers et al.

(10) Patent No.: US 8,793,918 B2
(45) Date of Patent: Aug. 5, 2014

(54) FIREARM BORE CLEANING DEVICE

(76) Inventors: William H. Rogers, St. Augustine, FL (US); Matthew E. McKendrick, Jacksonville, FL (US)

( * ) Notice: Subject to any disclaimer, the term of this patent is extended or adjusted under 35 U.S.C. 154(b) by 0 days.

(21) Appl. No.: 13/805,292

(22) PCT Filed: Nov. 2, 2010

(86) PCT No.: PCT/US2010/055067

§ 371 (c)(1),
(2), (4) Date: Dec. 18, 2012

(87) PCT Pub. No.: WO2011/162789

PCT Pub. Date: Dec. 29, 2011

(65) Prior Publication Data

US 2013/0091753 A1 Apr. 18, 2013

Related U.S. Application Data

(63) Continuation of application No. 29/364,487, filed on Jun. 24, 2010, now Pat. No. Des. 651,684.

(51) Int. Cl.
*F41A 29/00* (2006.01)

(52) U.S. Cl.
USPC ..... 42/95; 15/104.16

(58) Field of Classification Search
USPC ..... 42/95; 15/104.05, 104.16, 104.17, 15/104.18, 104.09
See application file for complete search history.

(56) References Cited

U.S. PATENT DOCUMENTS

| | | | | | |
|---|---|---|---|---|---|
| 51,362 | A * | 12/1865 | Sniegle | ..... | 15/104.16 |
| 99,557 | A * | 2/1870 | Gillette | ..... | 15/104.19 |
| 172,996 | A * | 2/1876 | Gregg | ..... | 15/104.16 |
| 268,004 | A * | 11/1882 | Davis | ..... | 401/9 |
| 387,410 | A * | 8/1888 | Gillette | ..... | 15/104.16 |
| 464,843 | A * | 12/1891 | Bagger | ..... | 401/9 |
| 566,041 | A * | 8/1896 | Warner | ..... | 15/104.19 |
| 2,544,150 | A * | 3/1951 | Franklin | ..... | 15/104.16 |
| 2,544,290 | A * | 3/1951 | Bailey | ..... | 15/104.16 |
| 2,805,434 | A * | 9/1957 | Hopkins | ..... | 15/104.16 |
| 4,399,627 | A * | 8/1983 | Malesky et al. | ..... | 42/95 |
| 4,716,673 | A * | 1/1988 | Williams et al. | ..... | 42/95 |
| 4,873,778 | A * | 10/1989 | Stipp | ..... | 42/95 |
| 6,699,331 | B1 * | 3/2004 | Kritzler | ..... | 134/8 |
| 2006/0162223 | A1 * | 7/2006 | Whipple | ..... | 42/95 |
| 2006/0236584 | A1 * | 10/2006 | Williams | ..... | 42/95 |

* cited by examiner

*Primary Examiner* — Gabriel Klein
(74) *Attorney, Agent, or Firm* — Arthur G. Yeager

(57) ABSTRACT

A firearm bore cleaning device includes a flanged cleaning head with an axially extending shaft having an attachment section and a flange mounting section, the attachment section being adapted to attach to a flexible cable assembly. The cleaning head includes at least one deformably resilient flange extending radially from the flange mounting section, and has a larger radius than the attachment section. The flange, flange mounting section and a portion of the attachment section can be integrally molded from an elastomeric material. The firearm bore cleaning device is urged through a firearm bore such that a wall of the firearm bore squeezingly engages the flange and is wiped to remove residue from the bore. The head may include an enlarged flange that removes residue from the firearm chamber. A plurality of spaced additional flanges are provided to maximize cleaning of the bore.

10 Claims, 5 Drawing Sheets

FIREARM BORE CLEANING DEVICE

CROSS-REFERENCE TO RELATED APPLICATION

This application is a continuation-in-part of U.S. Design application Ser. No. 29/364,487, filed on Jun. 24, 2010, the contents of which are herein incorporated by reference in their entirety.

FIELD OF THE INVENTION

The present invention relates to bore cleaning devices for firearms, and more particularly to devices that are urged through the firearm bore to remove residue and other fouling therefrom.

BACKGROUND OF THE INVENTION

Discharge of firearms results in the accumulation of various residues, including wax, varnish, copper, gun powder or the like residue in the bore and chamber thereof. Additionally, exposure to the elements such as rain, dirt, grit, mud and oxidation can also result in the fouling of the bore and other firearm components. Consequently, a regular cleaning regime of firearm cleaning, including cleaning of the bore, is known to be important to promote the accuracy, longevity, reliability and safety of the firearm.

A common step in prior art bore cleaning involves the urging of a cloth patch through the bore to remove such residues therefrom. The patch is typically inserted through the eye of a patch holder, and the patch holder is attached to a rod or cable and drawn through the bore. After each pass through the bore, the used patch is discarded and, if the used patch was dirty, a new patch is inserted and the process is repeated until a patch comes out clean. Various chemicals often are used, with and without brushes, to dislodge the residues and assist in the thorough cleaning of the firearm bore.

Although the patches are frequently introduced to the bore via the firing chamber of the firearm, the patches and patch holder are sized for close passage through the bore and typically do not effectively clean the firing chamber. However, additional patches may be used independently of the patch holder to clean the chamber, further increasing patch usage.

SUMMARY OF THE INVENTION

In view of the foregoing, it is an object of the present invention to provide an improved firearm bore cleaning device. According to an embodiment of the present invention, a firearm bore cleaning device includes a flanged cleaning head with an axially extending shaft having an attachment section and a flange mounting section, the attachment section being adapted to attach to a flexible cable assembly. The device further includes at least one deformably resilient flange extending radially from the flange-mounting section, the at least one flange having a larger radius than the attachment section and a larger radius of than the bore.

According to an aspect of the present invention, the at least one flange, the flange-mounting section and at least a portion of the attachment section are integrally molded from an elastomeric material.

According to another aspect of the present invention, the cleaning device is relatively rotatable with respect to the flexible cable assembly. This is of particular importance when the connection between the cleaning device and the cable is a threaded connection so that unthreading does not occur during use of the cleaning device in the bore and/or any brushes that may be threaded onto the cable connection.

According to a method aspect, the firearm bore cleaning device is urged through a firearm bore such that a wall the firearm bore squeezingly engages the at least one flange of the cleaning device and is wiped thereby to remove residue from the firearm bore.

These and other objects, aspects and advantages of the present invention will be better appreciated in view of the drawings and following detailed description of a preferred embodiment.

DETAILED DESCRIPTION OF PREFERRED EMBODIMENTS

Figure 1:
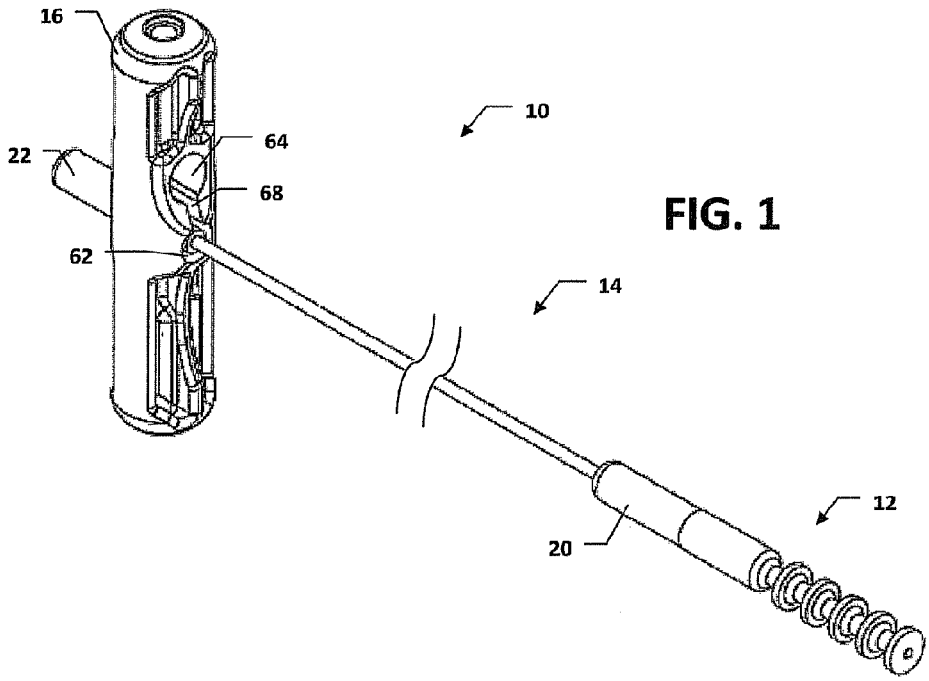
FIG. 1 is a perspective view of a bore cleaning device including a flanged cleaning head, a flexible cable assembly and a handle, according to an embodiment of the present invention.

Referring to FIGS. 1-4, according to an embodiment of the present invention, a bore cleaning device 10 includes a flanged cleaning head 12, a flexible cable assembly 14 and a handle 16. The cleaning head 12 and handle 16 are releasably attached to first and second ends 20, 22 of the cable assembly 14 so as to be rotatable relative thereto.

Figure 3:
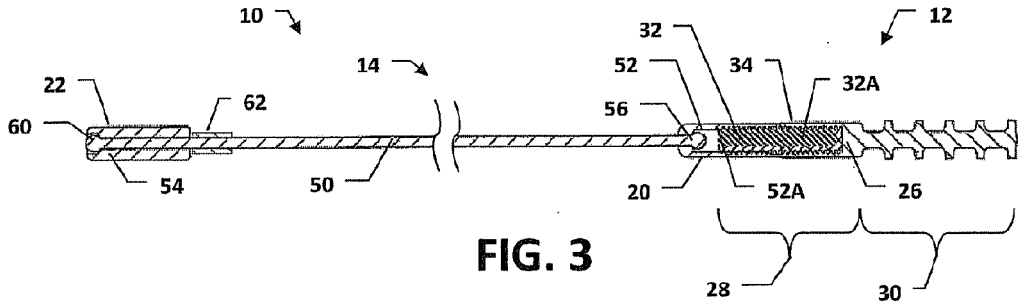
FIG. 3 is a sectional view taken along line 3-3 of FIG. 2.
Figure 4:
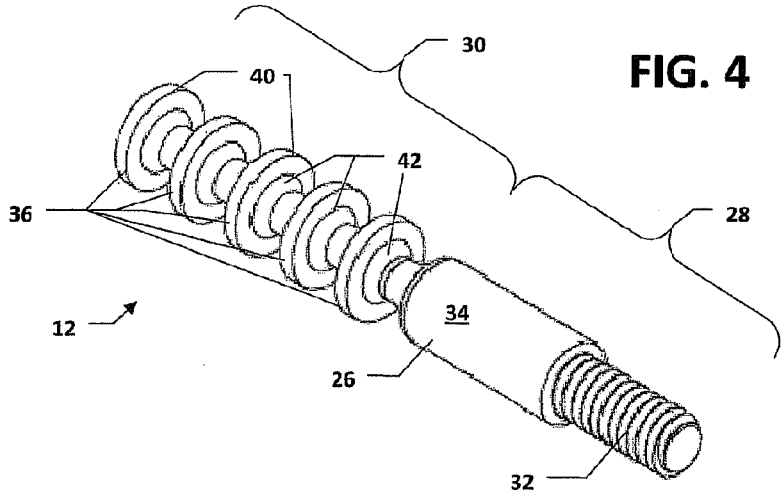
FIG. 4 is a perspective view of the cleaning head of FIG. 1.

The flanged cleaning head 12 includes an axially extending shaft 26 having an attachment section 28 and a flange mounting section 30. The attachment section 28 has a larger radius than the flange mounting section 30. The attachment section 28 is adapted for releasable attachment to the flexible cable assembly 14; for example, with a male threaded portion 32. Referring to FIG. 3, the male threaded portion 32 can advantageously be molded within an outer sheath 34. The overmolded segment of the male threaded portion is identified by numeral 32A.

The flanged cleaning head 12 also includes a plurality of spaced deformably-resilient flanges 36 extending radially from the flange mounting section 30. The plurality of flanges 36 are substantially disc shaped and have a larger radius than the attachment section 28. The flanges 36 extend generally orthogonal to the shaft 26 and are radially dimensioned to be squeezingly engaged by a firearm bore, while the attachment section 28 is radially dimensioned to freely pass through the firearm bore without interference. It will be appreciated that a range of flanged cleaning heads having different radial dimensions can be used to accommodate a wide range of firearm types and calibers.

Referring again to FIG. 4, to facilitate the squeezing engagement between the firearm bore and the flanges 36, while allowing the flanges 36 to accommodate irregular bore shapes, radial edges 40 of the flanges 36 are thinner than axially central portions 42. Advantageously, the flanges 36, the flange-mounting section 30 and the sheath 34 (see FIG. 3) of the attachment section 28 are integrally molded. A thermoplastic elastomer with suitable strength and chemical resistance properties is preferred to render the flanges deformably resilient. A suitable elastomer sold under the trade name HYTREL by E.I. du Pont de Nemours and Company has been found to be capable of repeated uses in cleaning firearm bores.

Referring again to FIGS. 2 and 3, the flexible cable assembly 14 includes a flexible cable 50 extending between generally opposed first and second end fittings 52, 54. The first end fitting 52 has an axially-extending channel therethrough and is rotatably disposed about the cable 50. The first end fitting 52 is adapted for releasable attachment with the cleaning head 12; for example, with a female threaded portion 52A into which male threaded portion 32 is engaged. A first enlarged cable bulbous end 56 prevents the first end fitting 52 from sliding off the cable 50 when the cleaning head 12 is detached. Such bulbous end 56 also permits relative rotation between cleaning device 12 and the flexible cable 50.

The second end fitting 54 also has an axially extending channel extending therethrough and is retained on the cable 50 by a similar second enlarged bulbous cable end 60 permitting relative rotation of the cable 50 with respect to second end fitting 54. A band 62 is crimped to affix the band 62 around the cable 50 to retain the second end fitting 54 proximate to the second end 22 of the flexible cable assembly 14.

The cable 50 is preferably formed from woven strands of metal wire. The cable 50 may be encased in a plastic coating, or the like, to minimize any scraping or marring of the cable on the firearm. When making the cable assembly 14, the end fittings 52, 54 are slid over respective ends and then the enlarged bulbous cable ends 56, 60 are formed by spot melting thereof. With the second end fitting 54 abutting the second enlarged bulbous cable end 60, the band 62 is crimped around the cable 50.

The handle 16 extends along an elongated handle axis which is perpendicular to the longitudinal axis of the cable 50 and the cleaning head 12. A first handle passageway 64 and a second handle passageway 66 extend generally perpendicular to the elongated handle axis. The first and second handle passageways 64, 66 are connected by a slotted passageway 68. The first handle passageway 64 has a diameter sufficient to accommodate the second end fitting 54 of the cable assembly 14. The second handle passageway 66 has a diameter sufficient to accommodate the band 62 rotatably therein but insufficient to accommodate the second end fitting 54. The width of slotted passageway 68 is sufficient to accommodate the flexible cable 50, but not the second end fitting 54 or the band 62 crimped to cable 50.

The handle 16 is attached by passing both the second end fitting 54 and the band 62 through the first handle passageway 64. The cable 50 is then passed through the slotted passageway 68 to the second handle passageway 66. The handle 16 is moved relative to the cable assembly 14 until the band 62 is seated within the second handle passageway 68 and the second end 22 engages the unseen surface of the handle 16. The flexible cable assembly 14 can then be securely pulled by the handle 16 without any dislodgement between the components. Removal of the handle 16 is accomplished in the reverse order.

Figure 2:
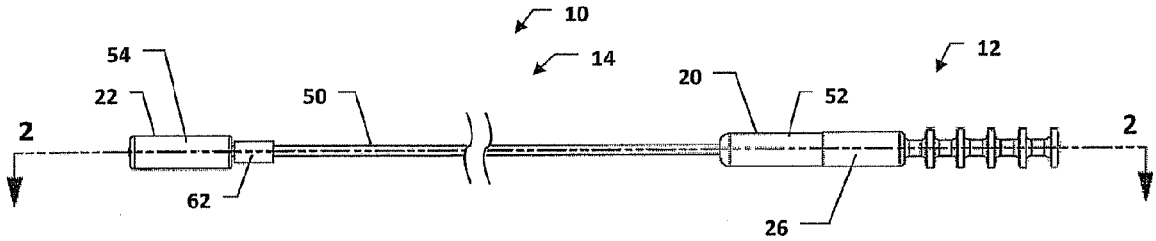
FIG. 2 is a side view of the cleaning head and cable of FIG. 1.
Figure 5:
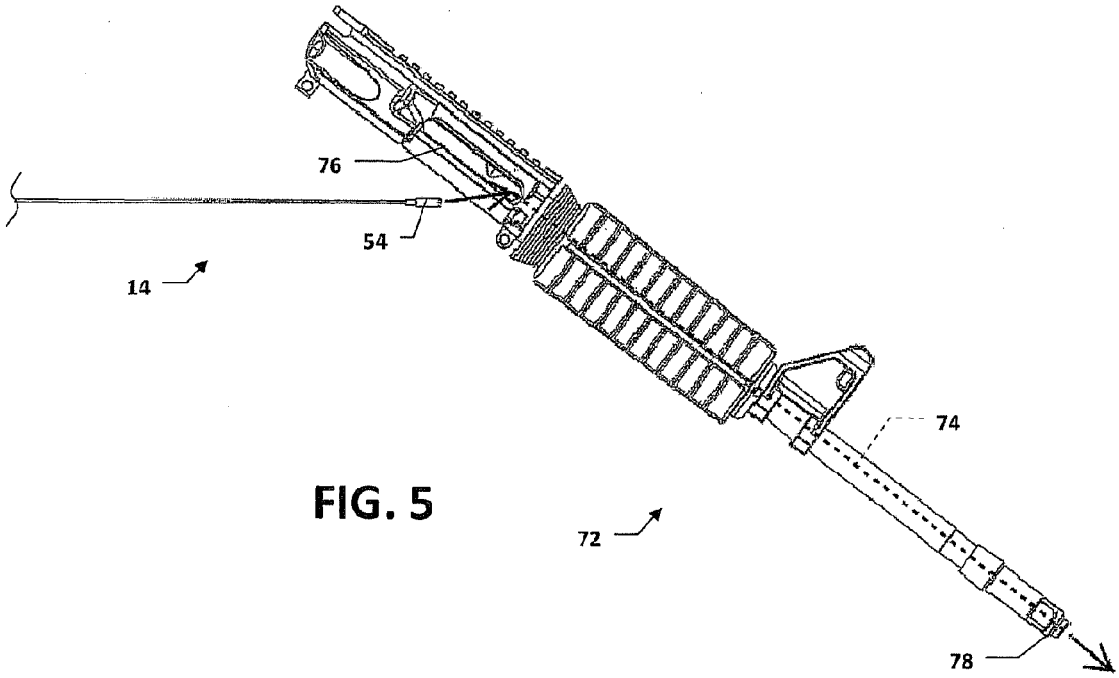
FIG. 5 is a side view of the flexible cable assembly of FIG. 1 being inserted into a bore of a firearm through a chamber thereof.

In operation, the flanged cleaning head 12 is attached to the first end 20 of the flexible cable assembly 14, as seen in FIG. 2. Referring to FIG. 5, the second end 22 of the cable assembly 14 is fed and/or dropped through the bore of a firearm 72 (along line 74), entering through the chamber 76 and exiting through the muzzle 78.

Figure 6:
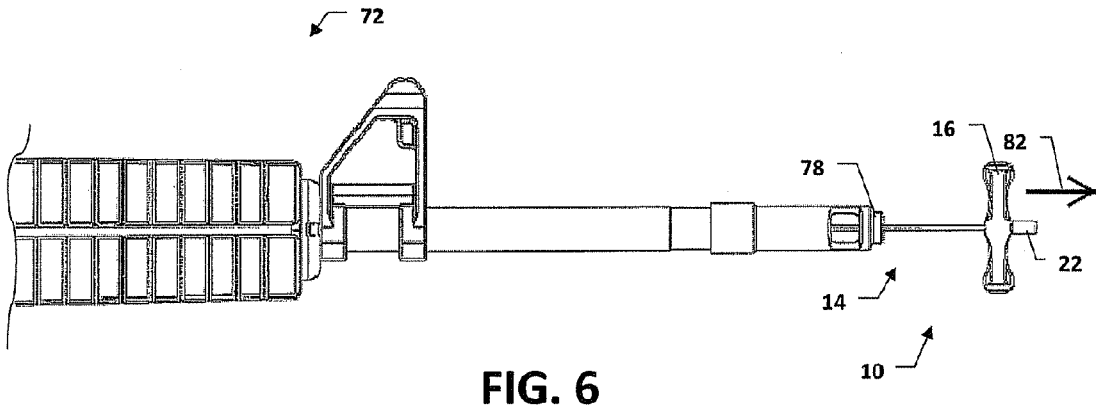
FIG. 6 is a side view the flexible cable assembly of FIG. 1 partially drawn through the firearm bore and extending out a muzzle of the firearm with the handle of FIG. 1 attached.
Figure 7:
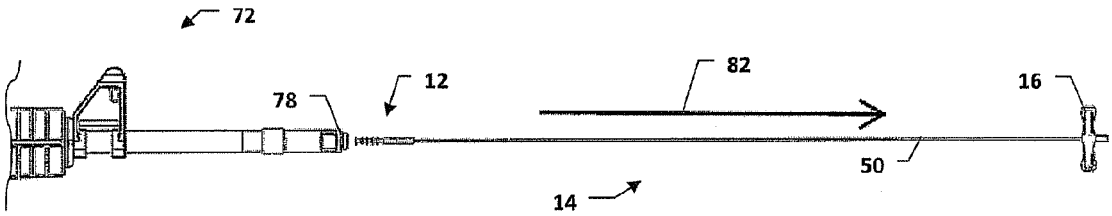
FIG. 7 is a side view of the bore cleaning device of FIG. 1 after being completely drawn through the firearm bore.

Referring to FIG. 6, once the second end 22 of the flexible cable assembly 14 is clear of the muzzle 78, the handle 22 is attached for movement to the band 62 (and second end 22 and cable 50). The bore cleaning device 10 is then completely drawn through the bore of firearm 72, in the direction of arrow 82, until the flanged cleaning head 12 exits the muzzle 78, as shown in FIG. 7. Because the flexible cable assembly 14 is rotatable relative to the cleaning head 12 and to the handle 16, torque applied to either the cleaning head 12 (e.g., due to engagement with rifling in the bore) or handle 16 during cleaning will not result in twisting of the cable 50 or unthreading of the threaded connection between head 12 and connection first end 20.

The cleaning head 12 can be cleaned of collected residue, the handle 16 removed, and the process repeated as necessary to complete cleaning of the bore of firearm 72. It will be appreciated from the foregoing that a bore cleaning device according to the present invention offers an effective, reusable and lint-free replacement for cloth patches and patch holders, as well as other commercial advantages.

The bore cleaning device 10 components can be packaged, in various states of disassembly, in firearm cleaning kits and the like. Additional firearm cleaning components can also be included in the kit, such as picks, scrapers and brushes. Various cleaning chemicals may also be included, such as carbon remover, copper solvent, bore polish and gun oil.

Figure 8:
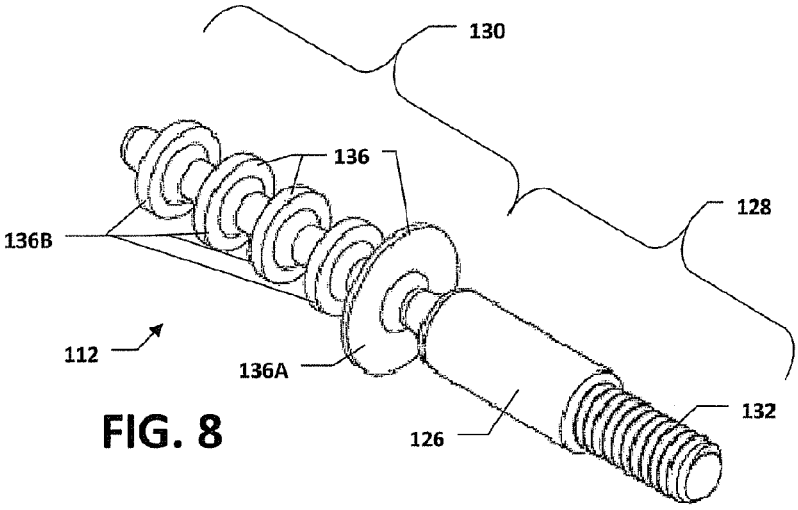
FIG. 8 is a perspective view of a flanged cleaning head, according to another embodiment of the present invention.

Other embodiments of the flanged cleaning head are further envisioned within the scope of the present invention. For example, referring to FIG. 8, another embodiment of a flanged cleaning head 112 includes an axially extending shaft 126 having an attachment section 128 and a flange-mounting section 130. The attachment section 128 is adapted for releasable attachment to a flexible cable assembly, such as the flexible cable assembly 14.

The flanged cleaning head 112 also includes a plurality of deformably resilient flanges 136 extending radially from the flange mounting section 130. The plurality of flanges 136 are substantially disc shaped and have a larger radius than the attachment section 128. Preferably, the flanges 136 include an increased diameter flange 136A, most proximate to the attachment section 128, and a plurality of additional flanges 136B.

The increased diameter flange 136A is radially dimensioned to be squeezingly engaged by a firearm chamber, while the additional flanges 136B are radially dimensioned to be squeezingly engaged by a firearm bore. The cleaning head 112 thus also assists in cleaning the firearm chamber which is larger than the bore of the firearm. Advantageously, the increased diameter flange 136A is thinner than the additional flanges 136B to facilitate the greater deformation needed to subsequently pass through the firearm bore ahead of the additional flanges 136B. Some of the residue picked up by flange 136A as it is pulled through the bore of the firearm may spill but is subsequently picked up by flanges 136B.

Figure 9:
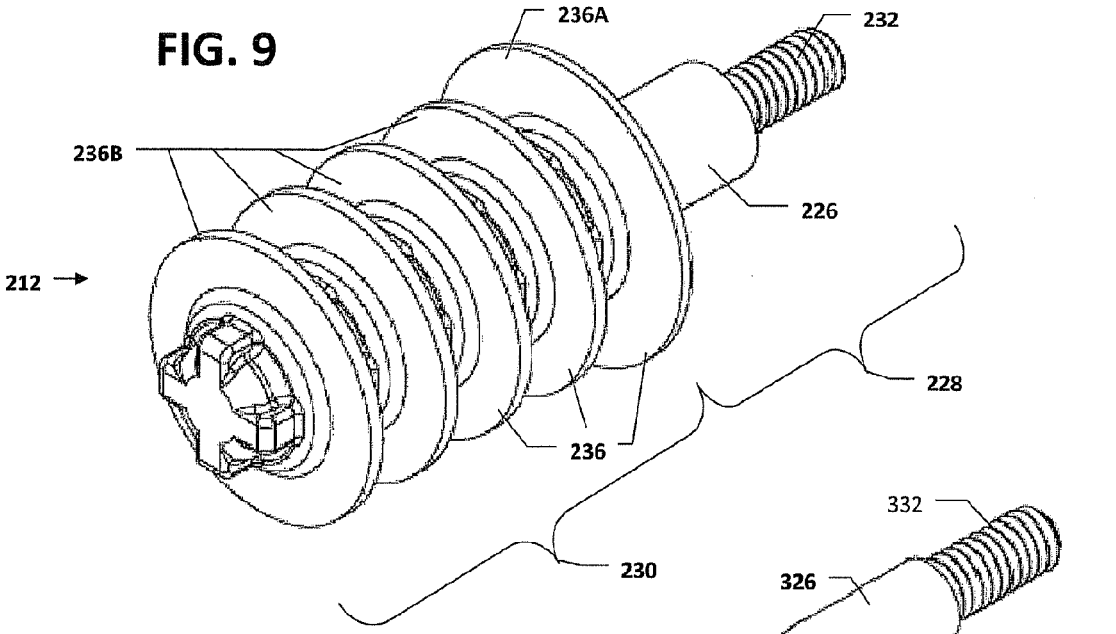
FIG. 9 is a perspective view of a flanged cleaning head, according to a further embodiment of the present invention.

In a further embodiment, referring to FIG. 9, a flanged cleaning head 212 includes an axially extending shaft 226 having an attachment section 228 and a flange-mounting section 230. The attachment section 228 is adapted for releasable attachment to a flexible cable assembly, such as the flexible cable assembly 14.

Figure 10:
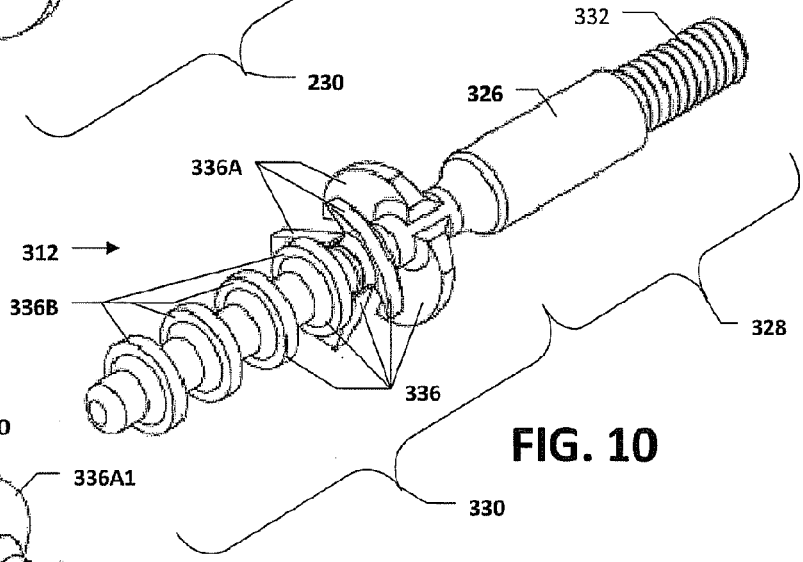
FIGS. 10 and 11 are perspective views of a flanged cleaning head, according to an additional embodiment of the present invention.
Figure 11:
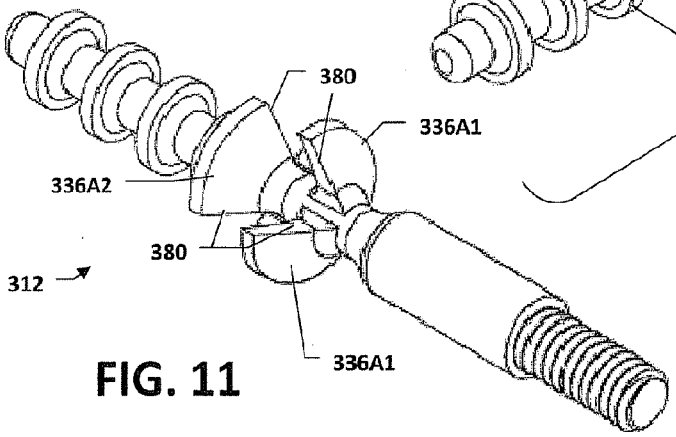

As discussed above, flanged cleaning heads can be dimensioned to accommodate a wide range of firearm types and calibers. The cleaning head 212 includes a plurality of deformably resilient flanges 236 extending radially from the flange mounting section 230 that are dimensioned for use in a firearm with a large bore, such as a shotgun. In particular, an increased radius flange 236A is radially dimensioned to be squeezingly engaged by a shotgun chamber, while the additional flanges 236B are radially dimensioned to be squeezingly engaged by a shotgun bore. Similar to the cleaning head 112, the increased diameter flange 236A is thinner than the additional flanges 236B to facilitate the greater deformation needed to subsequently pass through the shotgun bore ahead of the additional flanges 236B.

Where a flanged cleaning head includes one more increased radius flanges, other means can be used to increase the deformability of such flanges. For example, referring to FIGS. 10 and 11, a flanged cleaning head 312 includes an axially extending shaft 326 having an attachment section 328 and a flange mounting section 330. The attachment section 328 is adapted for releasable attachment to a flexible cable assembly, such as the flexible cable assembly 14.

A plurality of flanges 336 extend from the flange mounting section, including increased radius flanges 336A and a plurality of additional flanges 336B. The increased radius flanges 336A are radially dimensioned to be squeezingly engaged by a firearm chamber, while the additional flanges 336B are radially dimensioned to be squeezingly engaged by a firearm bore.

To increase the effective deformability of the increased radius flanges and ease passage through the firearm bore, they are formed as radially separated disc-sections and are angled toward the additional flanges 336B. To ensure 360 degree coverage by the flanges 336A, they are each bifurcated to include two axially and angularly offset pairs of flange sections 336A1, 336A2. The pairs of flange sections 336A1, 336A2 are angularly offset so that the gaps between the pair of flange sections 336A1 are completely covered by the pair of flange sections 336A2, and vice versa. Preferably, the angular extent of the pair of flange sections 336A1, 336A2 is such that there is slight overlap in wiping coverage between the adjacent edges 380 of the flange sections in pairs 336A1, 336A2.

Advantageously, the edges 380 of the pairs of flange sections 336A1, 336A2 do not extend radially outward from the axis of the shaft 326. Instead, the edges of each flange section of the pairs 336A1, 336A2 are offset by 90 degrees, and overlapping adjacent edges 380 are parallel. This configuration facilitates the molding process.

Figure 12:
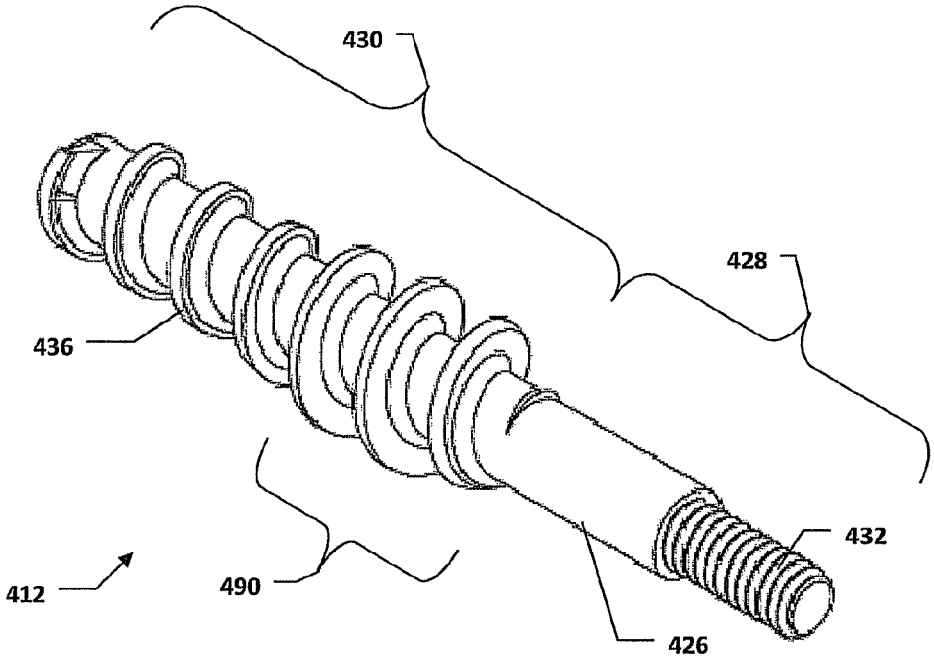
FIG. 12 is a perspective view of a flanged cleaning head, according to an alternate embodiment of the present invention.

While the flanges of the flanged cleaning head should be radially dimensioned to squeezingly engage a firearm bore and/or chamber for most effective cleaning, the present invention is not necessarily limited to any number or configuration of resiliently deformable flanges. In an additional embodiment, referring to FIG. 12, a flanged cleaning head 412 includes an axially extending shaft 426 having an attachment section 428 and a flange mounting section 430. The attachment section 428 is adapted for releasable attachment to a flexible cable assembly, such as the flexible cable assembly 14.

The flanged cleaning head 412 further includes at least one deformably resilient flange 436 extending axially in a spiral along the flange mounting section 430. The spiral flange 436 can advantageously include an increased radius section 490. The spiral flange 436 is radially dimensioned for squeezing engagement with a firearm bore, with the increased radius section being radially dimensioned for squeezing engagement with a firearm chamber. The increased radius section 490 can be thinner than rest of the spiral flange 436 to facilitate passage through the firearm bore.

Figure 13:
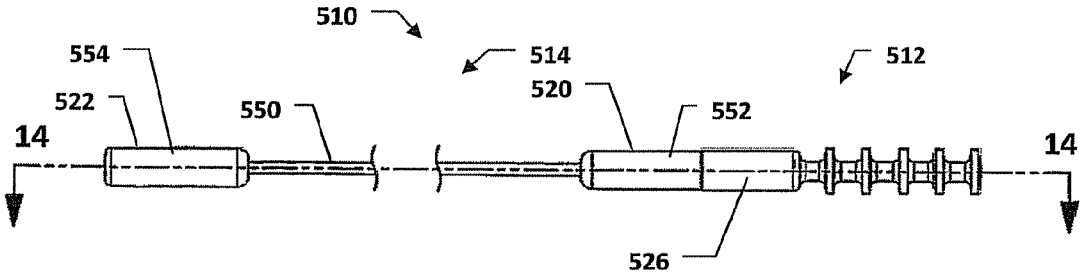
FIG. 13 is a side view of a cleaning head and cable, according to another embodiment of the present invention.
Figure 14:
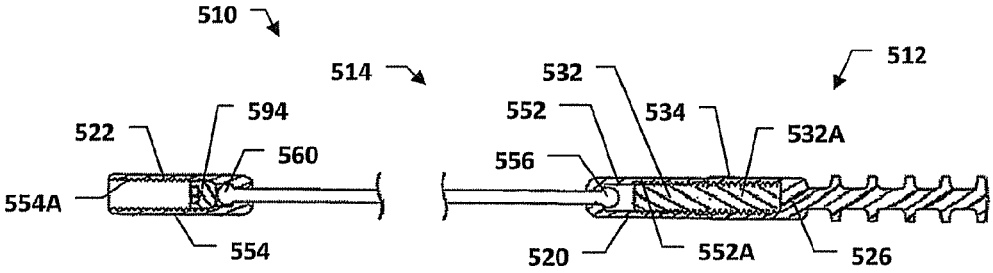
FIG. 14 is a sectional view taken along line 14-14 of FIG. 13.

Referring to FIGS. 13 and 14, according to another embodiment of the present invention, a flexible cable assembly 514 includes a flexible cable 550 extending between generally opposed first and second end fittings 552, 554 at respective first and second ends 520, 522 thereof. The first end fitting 552 has an axially-extending channel therethrough and is rotatably disposed about the cable 550. The first end fitting 552 is adapted for releasable attachment with a cleaning head 512; for example, with a female threaded portion 552A into which male threaded portion 532 is engaged. A first enlarged cable bulbous end 556 prevents the first end fitting 552 from sliding off the cable 550 when the cleaning head 512 is detached. Such bulbous end 556 also permits relative rotation between cleaning device 512 and the flexible cable 550.

The second end fitting 554 also has an axially extending threaded internal channel 554A extending therethrough and is retained on the cable 550 by a similar second enlarged bulbous cable end 560 permitting relative rotation of the cable 550 with respect to second end fitting 554. With the bulbous end 560 seated, an externally threaded set screw 594 is tightened down to its maximum extent in the channel 554A, spaced away slightly from cable end 560 so as not to interfere with its rotatability. Except as described above, the cable assembly 514 is preferably formed substantially the same as the cable assembly 14.

In general, the foregoing description of preferred embodiments is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A firearm bore cleaning device for use in cleaning firearm bores without using cloth patches or pads comprising:

a flanged cleaning head including:

an axially extending shaft having an attachment section with a threaded portion and an integral flange mounting section, the attachment threaded portion being attachable to a threaded end portion of a flexible cable assembly, the attachment section further including an integral sheath of deformably resilient material at least partially surrounding a forward end portion of the threaded portion;

a plurality of integrally molded elastomeric, deformably resilient and substantially disc shaped flanges extending radially from the flange mounting section and integrally molded with said sheath, each said flange having a larger radius than the attachment section and making contact with a firearm bore as the cleaning head is being pulled through a firearm bore, each said flange having a substantially flat outer radial edge extending parallel to the axially extending shaft, each of the radial edges having a thickness less than a central portion of the flanges; and the flexible cable assembly includes a flexible cable and a first end fitting for releasable connection to the attachment section, the first end fitting being rotatable relative to the flexible cable, a second end fitting rotatable relative to the flexible cable, such that the flexible cable is relatively rotatable at both ends as the flanged cleaning head is pulled through the bore so that said flexible cable remains in untwisted condition while said cleaning head is being pulled through a firearm bore.

2. The device of claim 1, wherein at least one of the plurality of additional disc shaped flanges has a radius greater than the other flanges.

3. The device of claim 2, wherein the at least one flange with the greater radius is axially proximate to the attachment section.

4. The device of claim 2, wherein the at least one flange with the greater radius has a thickness less than the other flanges to permit the at least one flange to pass through the firearm bore.

5. The device of claim 1, further comprising at least two spaced additionally resiliently deformable flanges, the at least two additional flanges forming separated disc sections each having a radius greater than the plurality of disc shaped flanges.

6. The device of claim 1, wherein the plurality of flanges extends axially in a spiral form along the flange mounting section.

7. The device of claim 6, wherein the spiral axially proximate to the attachment section is larger than the spiral remote from the attachment section.

8. The device of claim 1 further comprising:

a detachable handle extending perpendicular to said cable and said second end fitting and having a first enlarged passageway to accommodate said second end fitting being passed therethrough, another smaller passageway spaced from said first passageway, and a narrow slot accommodating passage of said cable therethrough and inhibiting passage of said second end fitting therethrough, said handle being graspable by a user to pull the bore cleaning device and cable through a bore of a firearm without dislodgement of the cable from the handle.

9. A method of cleaning a firearm bore without using cloth patches or pads, the method comprising:

pulling without any cloth patches or pads a firearm bore cleaning device as defined in claim 1 through a firearm bore such that a wall of the firearm bore squeezingly engages against the substantially flat outer radial edge of the plurality of radially extending deformably resilient flanges of the cleaning device and is wiped clean by movement of the firearm bore cleaning device through the firearm bore to remove residue from the firearm bore.

10. The method of claim 9, further comprising:

initially pulling the cleaning device through a firearm chamber prior to passing into the firearm bore such that a wall of the chamber squeezingly engages the at least one flange which wipes the chamber before the at least one flange enters the firearm bore.

* * * * *